US007651346B2

(12) United States Patent
Francis et al.

(10) Patent No.: US 7,651,346 B2
(45) Date of Patent: Jan. 26, 2010

(54) COMMUNICATION PORT

(75) Inventors: Michael E. Francis, Beaver Falls, PA (US); Steven William Marzo, Cortland, OH (US); John A. Yurtin, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/151,393

(22) Filed: May 6, 2008

(65) Prior Publication Data

US 2009/0280664 A1 Nov. 12, 2009

(51) Int. Cl.
*H01R 13/44* (2006.01)

(52) U.S. Cl. ..... 439/136; 174/67

(58) Field of Classification Search ..... 439/136, 439/135, 137, 145, 536; 174/66, 67, 68, 174/69; 220/292
See application file for complete search history.

(56) References Cited

U.S. PATENT DOCUMENTS

| | | | | | |
|---|---|---|---|---|---|
| 2,988,242 | A | * | 6/1961 | Kneip | 220/242 |
| 3,068,442 | A | * | 12/1962 | Kubik et al. | 439/136 |
| 3,432,611 | A | * | 3/1969 | Gaines et al. | 174/66 |
| 3,865,456 | A | * | 2/1975 | Dola | 439/137 |
| 4,282,674 | A | | 8/1981 | Hanson et al. | |
| 4,640,564 | A | * | 2/1987 | Hill | 439/137 |
| 4,713,016 | A | * | 12/1987 | Kato | 439/137 |
| 4,914,265 | A | * | 4/1990 | Mongeau | 200/330 |
| D307,578 | S | * | 5/1990 | Carson et al. | D13/158 |
| 5,011,419 | A | * | 4/1991 | Maan | 439/145 |
| 5,161,988 | A | * | 11/1992 | Krupka | 439/136 |
| 5,165,042 | A | * | 11/1992 | Klinger | 174/67 |
| 5,212,347 | A | * | 5/1993 | Powers et al. | 174/67 |
| 5,429,522 | A | | 7/1995 | Noschese et al. | |
| 5,449,860 | A | * | 9/1995 | Buckshaw et al. | 174/67 |
| 5,572,402 | A | | 11/1996 | Jeong | |
| 5,982,613 | A | | 11/1999 | Sternglass et al. | |
| 5,998,735 | A | * | 12/1999 | Patterson, Jr. | 174/67 |
| 6,049,192 | A | | 4/2000 | Kfoury et al. | |
| 6,062,893 | A | | 5/2000 | Miskin et al. | |
| 6,366,455 | B1 | | 4/2002 | Diaz et al. | |
| 6,372,987 | B1 | * | 4/2002 | Ha | 174/67 |
| 6,807,026 | B2 | | 10/2004 | Komatsu et al. | |
| 6,980,422 | B2 | | 12/2005 | Bhogal | |
| 7,094,969 | B1 | * | 8/2006 | In | 174/66 |
| 2002/0166272 | A1 | * | 11/2002 | Gaymon | 40/575 |
| 2004/0147148 | A1 | * | 7/2004 | Ng et al. | 439/137 |
| 2007/0169131 | A1 | | 7/2007 | Campbell et al. | |

* cited by examiner

*Primary Examiner*—T C Patel
*Assistant Examiner*—Harshad C Patel
(74) *Attorney, Agent, or Firm*—Thomas N. Twomey

(57) ABSTRACT

A communication port is susceptible to contaminates such as dirt, dust, and moisture if not properly protected. A communication port that automatically protects against contaminates includes a housing defining an opening and configured to receive a device connector. A face plate is disposed on the housing. The face plate defines a window generally aligned with the opening. A door is slideably disposed on the housing and biased toward a position covering the opening and the window. Exerting a force on the door exposes the opening and the window.

18 Claims, 4 Drawing Sheets

COMMUNICATION PORT

BACKGROUND

Communication ports are widely used to transmit data between electronic devices. For instance, universal serial bus (USB) ports are frequently used to transmit data between digital cameras and personal computers. A port used in this environment has minimal risk of exposure to contaminates such as dirt, dust, and moisture, which can reduce the effectiveness of the connection between the port and the electronic device, or alternatively, render the port completely inoperable. However, with the proliferation of portable electronic devices, there is an increased need for communication ports located outside a consumer's home where there is an increased risk for collecting contaminates inside an open communication port.

One known method for preventing exposure to contaminates is to provide a door or cover over the opening of the port. In most cases, however, existing port covers are actively employed, meaning that the user must manually remove the cover before connecting the electronic device to the communication port, and then manually replace the cover after the electronic device is removed. Although effective when used properly, these active covers cannot prevent contaminates from entering the port if the covers are not replaced.

Accordingly, a consumer port is needed that allows for passive protection against contaminates. In other words, a consumer port is needed that automatically covers the communication port when no electronic device is connected.

BRIEF SUMMARY

A communication port includes a housing defining an opening and configured to receive a device connector. A face plate is disposed on the housing. The face plate defines a window generally aligned with the opening. A door is slideably disposed on the housing and biased toward a position covering the opening and the window. Exerting a force on the door exposes the opening and the window.

BRIEF DESCRIPTION OF THE DRAWINGS

The present embodiments become better understood by reference to the following detailed description when considered in connection with the accompanying drawings, wherein.

DETAILED DESCRIPTION

A passive communication port automatically closes a door to protect a device connector from contaminants, such as dirt, dust, and moisture. The device connector is partially surrounded by a housing and accessible via an opening. A face plate covers a front part of the housing and includes window to allow access to the device connector via the opening. The door is located on the housing over the window and the opening. The door will remain closed until a force strong enough to overcome a bias pushing the door closed is overcome. When the door is open, the device connector is accessible through the window and the opening.

Figure 1:
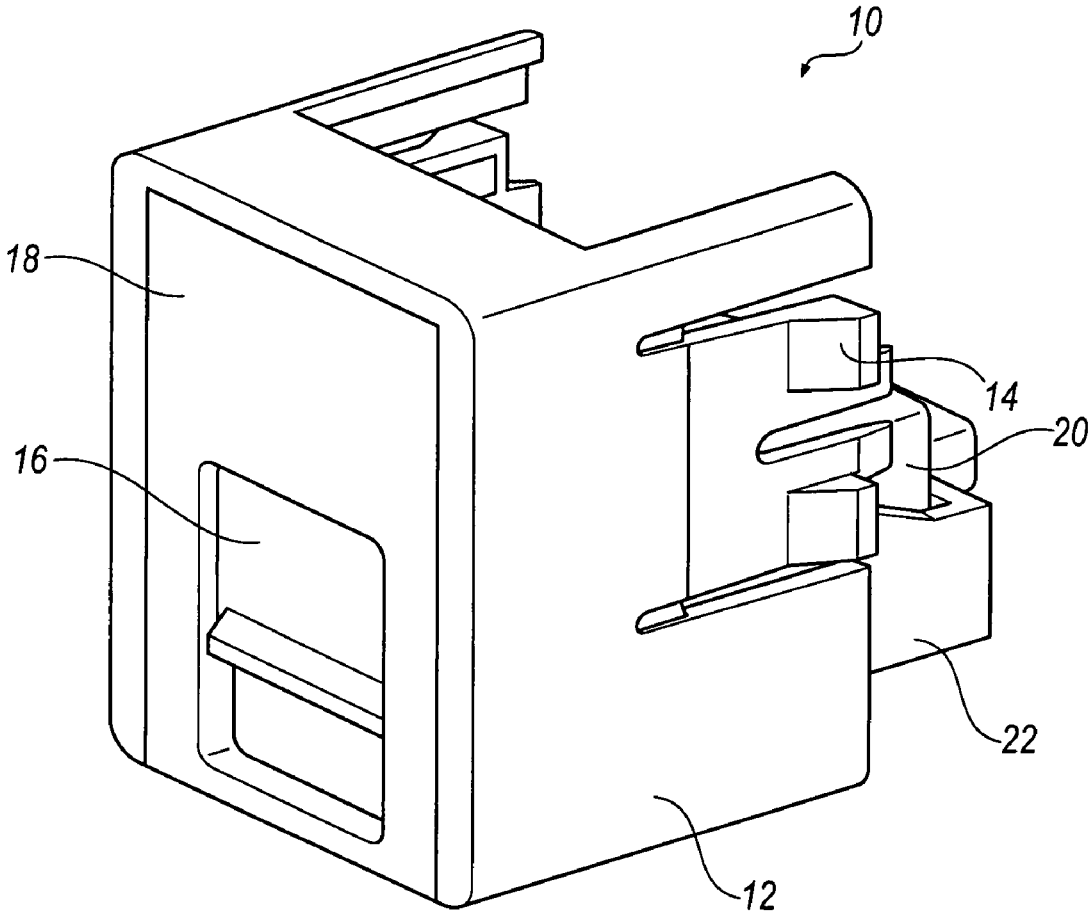
FIG. 1 is a perspective view of a communication port assembled according to an embodiment.
Figure 5:
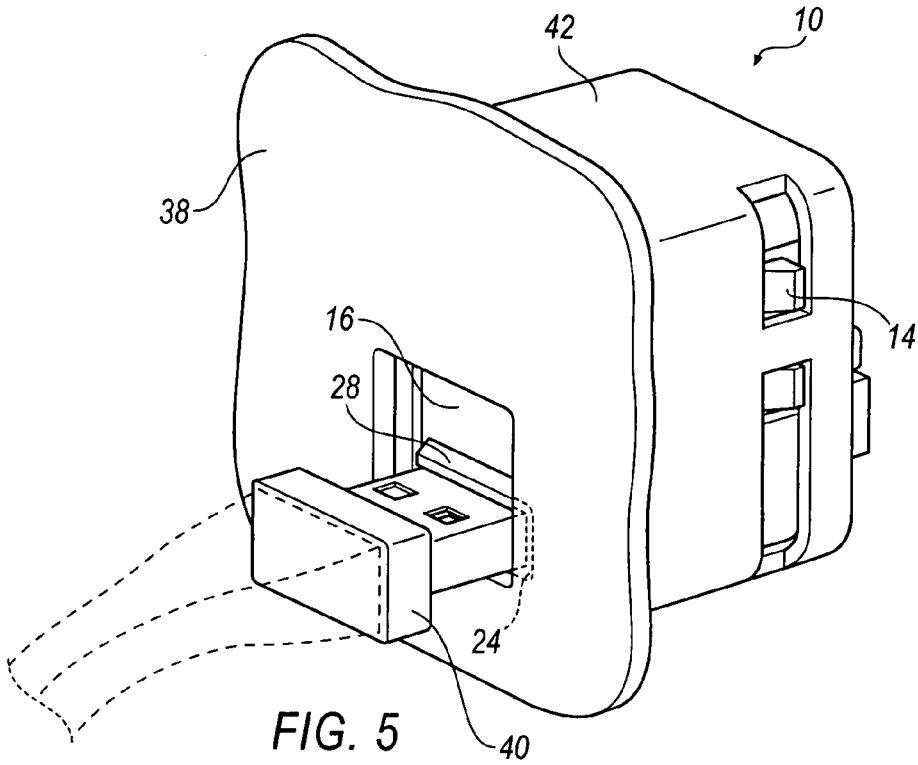
FIG. 5 is a perspective view of the communication port disposed on the interior surface and an electronic device inserted into a recessed portion of the plate to move the door from a closed position to the open position.
Figure 6:
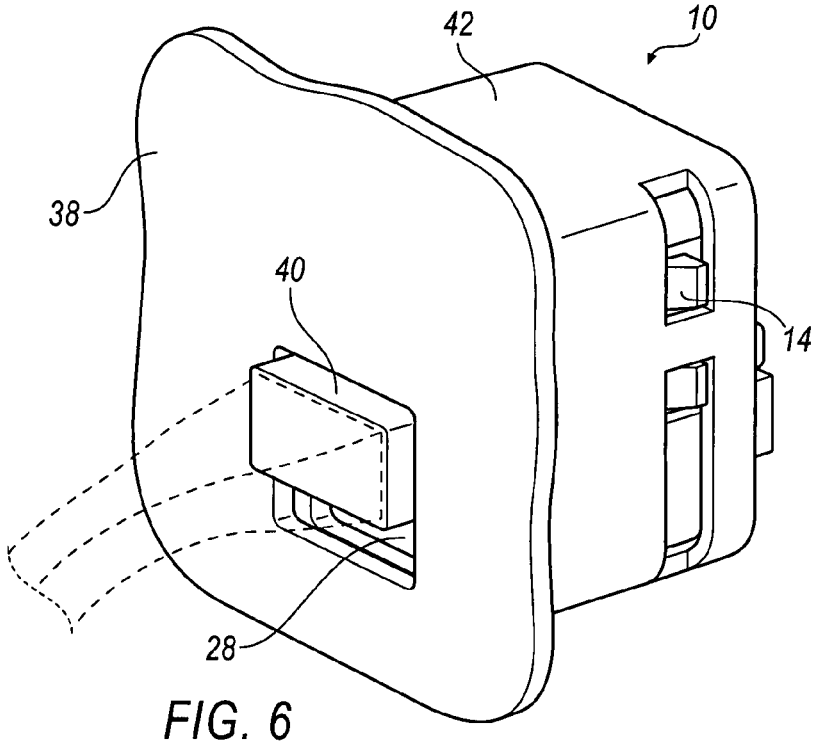
FIG. 6 is a perspective view of the communication port disposed on the interior surface and the electronic device inserted into a connector while the door is in the open position.

The Figures refer to exemplary embodiments wherein like numerals indicate like or corresponding parts. FIG. 1 illustrates a perspective view of an exemplary communication port 10 having a housing 12 with integrally formed clips 14 for connecting the port to another structure. The housing 12 may be formed from a non-conductive material, such as plastic. On a front side of the housing 12 is an access port that includes a self-closing door 16 that cooperates with a window in a face plate 18. The access port is configured to receive an electronic device 40 as shown in FIGS. 5 and 6 having a connection interface such as a USB interface, a parallel port interface, or a fire wire. Within the communication port 10, the consumer connection interface mates with a device connector 20, which in one embodiment, is installed through a back side of housing 12. The device connector 20 is supported within the communication port 10 by a retention mechanism 22. The retention mechanism 22 may include any mechanism for retaining the device connector 20 within the communication port 10, including, but not limited to, the application of side locks, a loose pick lock, or as shown in FIG. 1, a molded tray in which device connector 20 is rotated into the tray to provide additional push-out resistance when the consumer interface is mated with the device connector 20.

Figure 2:
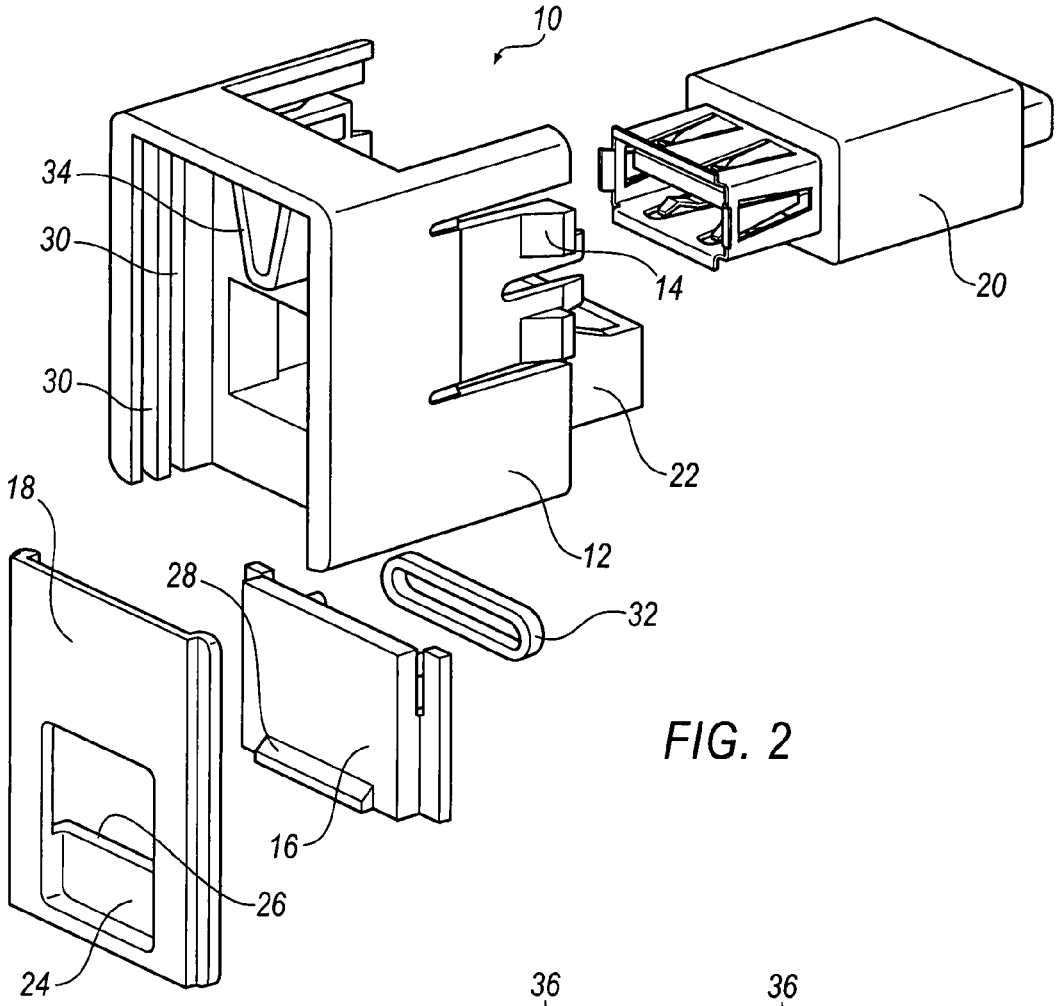
FIG. 2 is an exploded view of the communication port according to an embodiment

FIG. 2 illustrates an exploded view of the exemplary communication port 10 of FIG. 1. The face plate 18 includes a recessed portion 24 presenting a ledge 26 to support the door 16 when closed. Furthermore, the door 16 may include a lip 28 that extends toward the front of the housing 12 to allow an upward force to be applied to open the door 16. The lip 28 may also limit movement of the door 16 relative to the face plate 18. Both the door 16 and the face plate 18 are placed in slots 30 in the housing 12. When in the slots 30, the window of the face plate 18 is generally aligned with an opening defined by the housing 12. The face plate 18 may be locked in place with friction or a locking device (not shown) to prevent it from sliding in the slot. On the other hand, the door 16 is able to slide in the slot to cover the window and the opening. Moreover, the door 16 is biased to cover the window and the opening to prevent contaminants like dirt, dust and moisture from entering into the communication port 10. In one embodiment, a biasing device 32, such as a spring, a stretchable band, a block of foam, or any other device that may be stretched or compressed, is disposed on the door 16 and the housing 12. The biasing device 32 pushes against the housing 12 so that the door 16 covers the opening and window. As illustrated, the biasing device 32 may push against a boss 34 that may be generally v-shaped and integrally formed with the housing 12.

Figure 3:
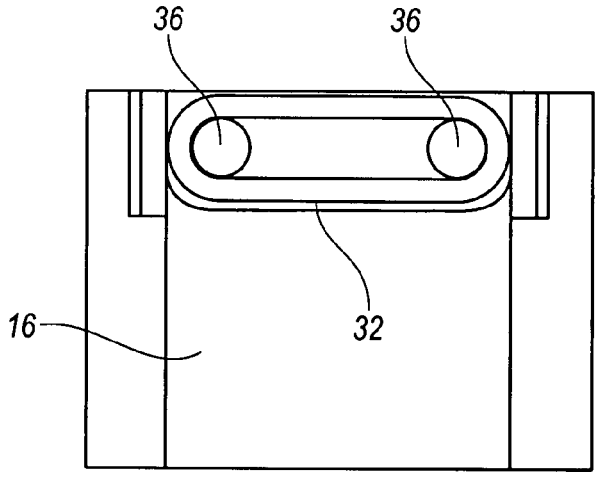
FIG. 3 is a rear view of a door of the communication port having a biasing device disposed thereon according to an embodiment.
Figure 4:
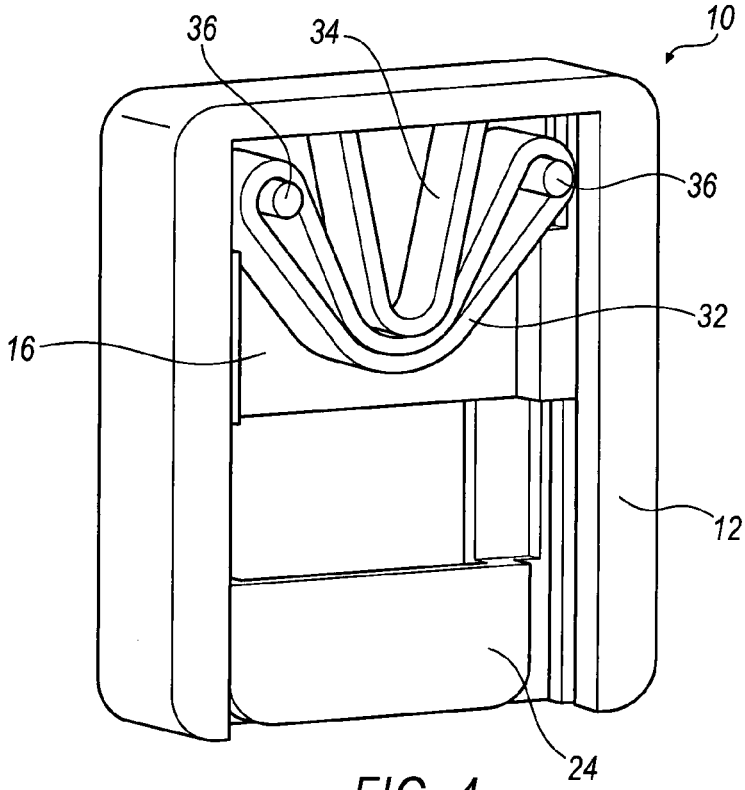
FIG. 4 is a rear view of the door and the plate disposed in the communication port in an open position according to an embodiment.

FIGS. 3 and 4 illustrate an embodiment of the biasing device 32 disposed on the door 16. As shown in FIG. 3, the door 16 may include a pair of posts 36 that support the biasing device 32 and give the biasing device 32 something to push against. FIG. 4 illustrates the door 16 being open and the biasing device 32 pushing against the boss 34. Even when the door 16 is closed, the biasing device 32 may continue to exert a force on the door 16 to, for instance, prevent rattling. However, exerting an upward force on the lip 28 pushes against the biasing device 32 and opens the door 16. Note that the clips 14, device connector 20, and retention mechanism 22 are not illustrated in FIG. 4 so that the biasing device 32 may be viewed more clearly.

FIGS. 5 and 6 illustrate the communication port 10 mounted to a structure 38 and an electronic device 40 is shown opening the door 16. Referring to FIG. 5, in operation, the electronic device 40 may be inserted into the recessed portion 24 of the face plate 18 and may exert a force on the lip 28 of the door 16 against the biasing device 32 to open the door 16. Referring to FIG. 6, with the door 16 open, the electronic device 40 may be plugged into the device connector 20, which prevents the door 16 from closing even though the biasing device 32 continues to push on the door 16 and the boss 34.

Figure 7:
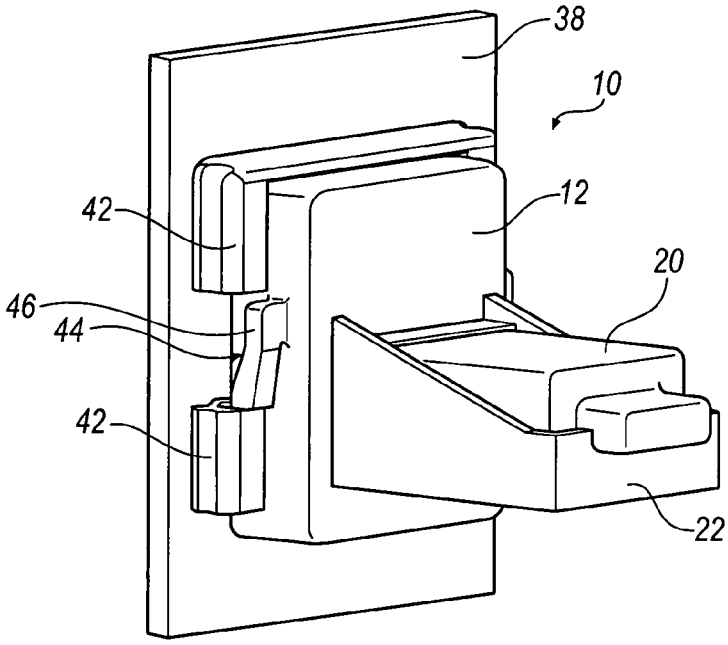
FIG. 7 is a rear view of the communication port disposed on an interior surface of a vehicle according to an embodiment.

Furthermore, FIGS. 5-7 illustrate how the communication port 10 may be mounted to the structure 38. In FIGS. 5 and 6, the structure 38 presents a surface having inwardly extending walls 42 defining spaces. The clips 14 on the housing 12 extend into the spaces to limit movement of the communication port 10. Alternatively, FIG. 7 is a rear view of the communication port 10 mounted to the structure 38 via a locking mechanism 44. In this embodiment, the structure 38 presents the surface having inwardly extending walls 42 defining a gap. The locking mechanism 44 includes a lock 46 disposed on the side of the housing 12, that extends into the gap. As the lock 46 rests in the gap, movement of the communication port 10 is limited.

It is to be understood that the above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A communication port comprising:

a housing defining an opening and configured to receive a device connector, said housing having a first slot having open ends for slideably installing a door therein;

said door and first open slot being dimensioned to provide sliding motion of said door in said first slot between a closed and open position with respect to said opening;

a face plate disposed on said housing, said face plate includes a window generally aligned with said opening;

said face plate further defines a recessed portion presenting a ledge to support said door when said door is closed and to prevent said door from disengaging said first slot when said face plate is disposed on said housing; and said door slideably disposed on said housing and biased toward a position covering said opening and said window and wherein exerting a force on said door exposes said opening and said window.

2. A communication port as set forth in claim 1, further including a biasing device disposed on said door and said housing, wherein said biasing device is configured to exert a force against said housing to close said door.

3. A communication port as set forth in claim 2, wherein said housing further includes a boss extending from said housing and wherein said biasing device exerts a force on said boss.

4. A communication port as set forth in claim 2, wherein said door further includes a lip extending from said door and wherein exerting a force on said lip against said biasing device opens said door.

5. A communication port as set forth in claim 1, wherein said face plate is configured to receive the electronic device.

6. A communication port as set forth in claim 1, wherein said recessed portion is configured to limit the movement of said door relative to said face plate.

7. A communication port as set forth in claim 1, wherein said door includes a lip and wherein exerting a force on said lip opens said door.

8. A communication port as set forth in claim 1, wherein said housing includes a second slot, wherein said second slot is configured to slideably receive said face plate.

9. A communication port as set forth in claim 1, further comprising a locking mechanism disposed on said housing.

10. A communication port as set forth in claim 9, wherein said locking mechanism includes a lock extending from said housing and configured to extend into a gap defined by a structure such that said housing is mounted to the structure.

11. A communication port as set forth in claim 1, wherein said housing includes a retention mechanism configured to receive the device connector.

12. A communication port as set forth in claim 1 wherein said ledge extends axially within the axial extent of said first slot when said face plate is disposed on said housing.

13. A communication port as set forth in claim 12, wherein said housing includes a second slot, wherein said second slot is configured to slideably receive said face plate; and said ledge extends axially within the extent of said first slot when said face plate is installed in said second slot.

14. A communication port as set forth in claim 1 wherein said door being a unitary one-piece door.

15. A communication port comprising:

a housing defining an opening and configured to receive a device connector;

a face plate disposed on said housing, said face plate includes a window generally aligned with said opening;

a door slideably disposed on said housing in a first slot and biased toward a position covering said opening and said window and wherein exerting a force on said door exposes said opening and said window;

one of said door and housing having mounting posts for mounting a biasing element; and the other of said housing and door includes a boss extending and wherein said biasing element exerts a force on said boss between said posts to bias said door to a closed position.

16. A communication port as set forth in claim 15, wherein said door further includes a lip extending from said door and wherein exerting a force on said lip against said biasing element opens said door.

17. A communication port as set forth in claim 16, wherein said face plate further defines a recessed portion presenting a ledge to support said door when said door is closed.

18. A communication port as set forth in claim 17, wherein said recessed portion is configured to limit the movement of said door relative to said face plate.

* * * * *